United States Patent [19]

Bailey

[11] 4,440,390

[45] Apr. 3, 1984

[54] NOVELTY CUP FOR FORCIBLY EJECTING LIQUID

[76] Inventor: Clayton G. Bailey, P.O. Box 69, Port Costa, Calif. 94569

[21] Appl. No.: 392,735

[22] Filed: Jun. 28, 1982

[51] Int. Cl.[3] ..... A63J 23/00

[52] U.S. Cl. ..... 272/27 N

[58] Field of Search ..... 272/1 R, 8 R, 8 N, 27 R, 272/27 N; 46/1 D, 6, 7, 14

[56] References Cited

U.S. PATENT DOCUMENTS

| | | | |
|---|---|---|---|
| 978,681 | 12/1910 | Walther | 272/27 R |
| 1,030,859 | 7/1912 | Anagnostou | 272/8 R |
| 1,381,458 | 6/1921 | Dorris | 46/7 |
| 1,775,747 | 9/1930 | Ake | 272/8 R |
| 4,289,109 | 9/1981 | D'Andrade | 124/67 |

FOREIGN PATENT DOCUMENTS

| | | | |
|---|---|---|---|
| 1023384 | 1/1958 | Fed. Rep. of Germany | 272/8 R |
| 2210786 | 9/1973 | Fed. Rep. of Germany | 272/27 N |
| 356580 | 7/1922 | German Democratic Rep. | 272/27 R |

OTHER PUBLICATIONS

Barr, George, *Show Time for Young Scientists,* New York, McGraw-Hill, 1965, pp. 138-139.

*Primary Examiner*—Richard T. Stouffer

*Attorney, Agent, or Firm*—James J. Burke, II

[57] ABSTRACT

A cup, including a closed annular chamber and a vertical passage. When the main central chamber is filled with a liquid, the liquid also fills the vertical passage, but air is trapped and compressed to a degree in the annular chamber. When the cup is tilted as for drinking, trapped, compressed air reaches the vertical passage and squirts liquid therein into the drinker's face.

3 Claims, 2 Drawing Figures

FIG.1
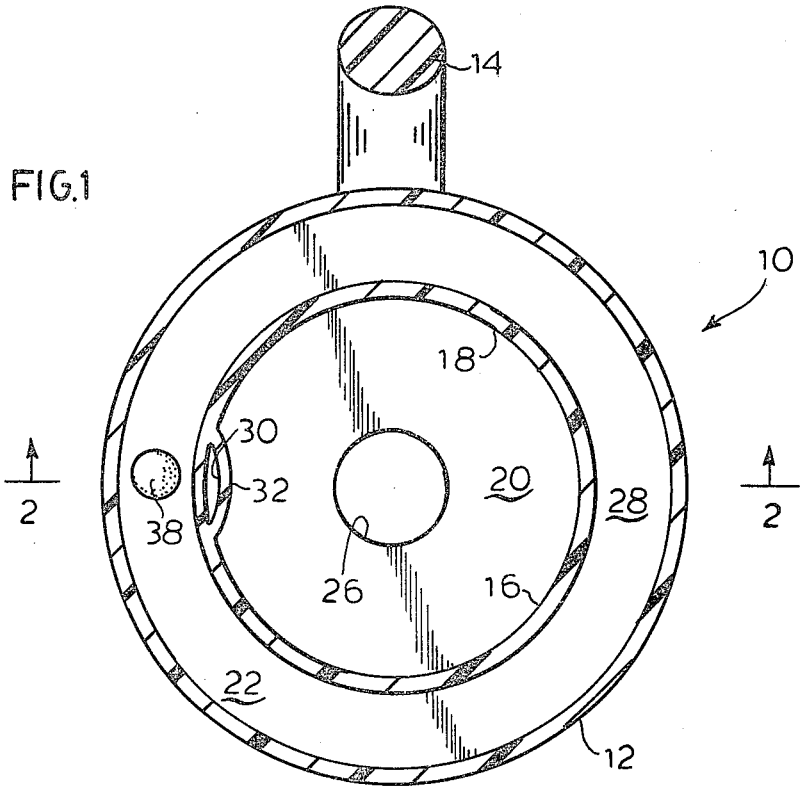
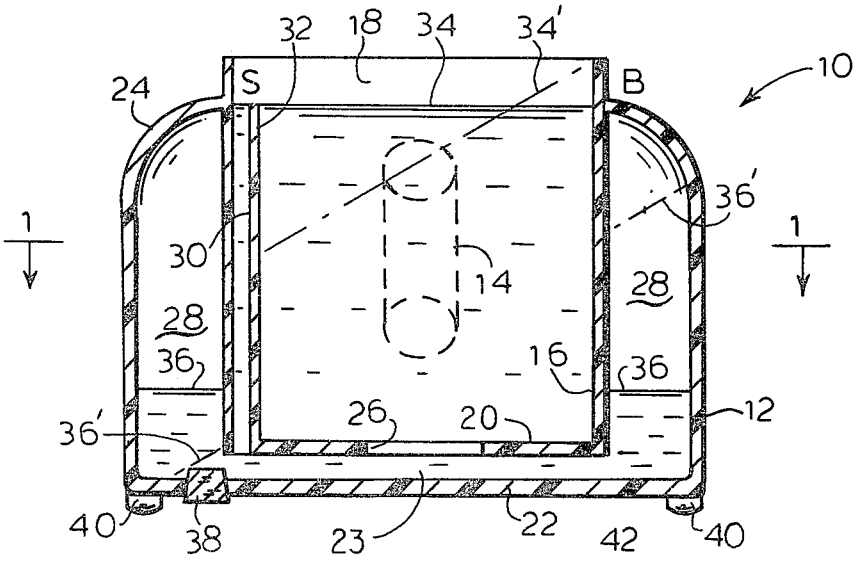
FIG. 2

NOVELTY CUP FOR FORCIBLY EJECTING LIQUID

BACKGROUND OF THE INVENTION

The present invention relates in general to novelty items and, more particularly, it relates to a cup which, in use, squirts liquid into the user's face.

Novelty cups are known. A glass with a double wall forming a chamber filled with a colored liquid, which appears to be full when it is quite empty, is one example. A cup with the handle on the inside instead of the outside, accompanied by a humorous reference to the maker, is another.

OBJECTS OF THE INVENTION

A general object of the present invention is to provide a cup which is adapted in use to squirt liquid into a user's face. Various other objects and advantages of the invention will become clear from the following description of a preferred embodiment, and the novel features will be particularly pointed out in connection with the appended claims.

THE DRAWINGS

Reference will hereinafter be made to the accompanying drawings, wherein:

FIG. 1 is a cross-sectional top view of a cup in accordance with the invention, taken along line 1—1 of FIG. 2; and FIG. 2 is a cross-sectional elevation view, taken along line 2—2 of FIG. 1, which also schematically illustrates operation of the cup.

DESCRIPTION OF THE EMBODIMENTS

With reference to the drawings, a cup 10 according to the invention comprises a cylindrical outer wall 12 having a suitable handle 14 attached at one side, a cylindrical inner wall 16 defining the top, open end 18 or lip of cup 10 and having an open, false bottom 20 therein which is vertically spaced from the real cup bottom 22 (FIG. 2), defining therebetween a bottom chamber 23. Outer wall 12 is secured to inner wall 16 by means of an integral annular shoulder 24 surrounding but lower than the open lip 18, and false bottom 20 includes a large area opening 26, so that a closed-top, open-bottom chamber 28 is formed between inner and outer walls 12, 16. Lastly and most importantly, a small area vertical passage 30 is formed along inner wall 16 at a position thereon to the right of and about 90° away from handle 14. Passage 30 is open at its upper end near lip 18 and extends downwardly through false bottom 20 so as to be in fluid communication with chamber 23 and chamber 28. Passage 30 is conveniently formed by securing a strip of a suitable material to inner wall 16 along the strip edges, as shown in the drawings, but a tube could also be used. Alternatively, passage 30 could run on the outside of inner wall 16, or be entirely within it.

Thus, when the cup is empty, chamber 28 is closed at the top by shoulder 24, but is in communication with the atmosphere via both opening 26 and vertical passage 30.

When a liquid is poured into cup 10, it flows through opening 26 in false bottom 20, and into chamber 28, trapping air in the annular portion thereof between inner wall 16 and outer wall 12. The liquid rises in vertical passage 30, since this is open at the top. As the liquid fills the main portion of cup 10 its weight raises the liquid level in chamber 28 somewhat, causing a corresponding compression of the air in chamber 28. So, when the cup is essentially full, as shown at 34 in FIG. 2, the fluid level in chamber 28 will be about as shown at 36.

In use, the user will, by grasping the cup in his right hand and drinking from it, effectively rotate the cup in a clockwise direction around the axis of handle 14, as shown in FIG. 2. In the embodiment shown, left-handed drinkers will not enjoy the fun. A cup for such persons would require passage 30 to be on the opposite side of inner wall 16. Either way, it is apparent that passage 30 must be about 90° displaced from the (vertical) plane of handle 14. As the cup is tipped the fluid levels change as shown in phantom at 34' and 36', but the compressed volume of air in chamber 28 remains the same. When this air pushes against the much lesser weight of liquid in passage 30, it expands and squirts that liquid into the face of the user. Depending on the speed of reaction of the user, the cup may squirt two or more times before the trapped air returns to ambient pressure.

As is apparent from the drawings, emptying cup 10 completely by merely inverting it is essentially impossible. So as to prevent residual liquid from remaining in cup 10 and becoming stale or dirty in non-use, and also to facilitate rinsing, a plug 38 is provided in the bottom. To keep cup 10 from being unstable when resting on a surface because of plug 38, it is preferred as well to provide an annular rim 40 around the outer edge. As shown in the drawings, cup 10 is fabricated of ceramic, and this is a preferred material, but it will be appreciated that any moisture-impervious material may be employed. If a more fragile material is used, extra support for false bottom 20 may be provided by posts 42. Also, it will be appreciated that as long as the essential operative parts are in the proper relation, the size and exterior may be varied, taking any sort of decorative or amusing shape. As an example, a cup shaped like a volcano, in honor of Mt. St. Helens, "erupts" when drunken from.

Various changes in the details, steps, materials and arrangements of parts, which have been herein described and illustrated to explain the nature of the invention, may be made by those skilled in the art within the principle and scope of the invention as defined in the appended claims.

What is claimed is:

1. A novelty cup comprising:

inner and outer side walls forming a cylindrical cup chamber and a surrounding annular chamber closed at the top by an annular shoulder, the upper edge of said inner wall forming a cup lip, said inner and outer side walls and said annular shoulder being free of openings and gaps such that air may be trapped and compressed within said annular chamber;

a cup bottom between the lower edges of said outer side wall;

a second, false bottom spaced above said cup bottom and between the lower edges of said inner side wall and defining with said cup bottom a bottom chamber, said false bottom including an enlarged opening allowing fluid communication between said cup chamber, said bottom chamber and said annular chamber;

a vertical passage on said inner wall of substantially smaller diameter than said enlarged opening and extending from near said lip through said false bottom;

said cup being so constructed that when a liquid is added to said cup to a substantially greater depth than said false bottom, air is sufficiently compressed within said annular chamber, such that when said cup is tilted to where said compressed air reaches said vertical passage, said air expands against the lesser weight of liquid therein and forcibly ejects said liquid upwardly through said vertical passage.

2. The novelty cup as claimed in claim 1, and additionally comprising a plug-closeable opening in said cup bottom.

3. The novelty cup as claimed in claim 1, and additionally comprising a cup handle affixed to the outer side of said outer side wall, said handle being displaced about 90° from said vertical passage.

* * * * *